US010688503B2

(12) United States Patent
Henne et al.

(10) Patent No.: US 10,688,503 B2
(45) Date of Patent: Jun. 23, 2020

(54) HYBRID ROTOR FOR A CENTRIFUGE, SET COMPRISING A HYBRID ROTOR AND A CENTRIFUGE CONTAINER, AND CENTRIFUGE CONTAINER

(71) Applicant: Thermo Electron LED GmbH, Langenselbold (DE)

(72) Inventors: Sebastian Henne, Goettingen (DE); Sven Stephan, Bischofferode (DE)

(73) Assignee: Thermo Electron LED GmbH, Langelselbold (DE)

( * ) Notice: Subject to any disclaimer, the term of this patent is extended or adjusted under 35 U.S.C. 154(b) by 0 days.

(21) Appl. No.: 15/048,194

(22) Filed: Feb. 19, 2016

(65) Prior Publication Data

US 2016/0310966 A1 Oct. 27, 2016

(30) Foreign Application Priority Data

Apr. 23, 2015 (DE) ..... 10 2015 005 195

(51) Int. Cl.
*B01L 3/00* (2006.01)
*B01L 9/06* (2006.01)
*B04B 5/04* (2006.01)

(52) U.S. Cl.
CPC ..... *B04B 5/0421* (2013.01); *B01L 3/5021* (2013.01); *B04B 5/0414* (2013.01);
(Continued)

(58) Field of Classification Search
CPC ... B04B 5/0421; B04B 5/0414; B01L 3/5021; B01L 2300/0858; B01L 9/06; B01L 2200/02
(Continued)

(56) References Cited

U.S. PATENT DOCUMENTS 4,154,690 A 5/1979 Ballies
4,375,272 A * 3/1983 Sutton, III ..... B04B 5/0414 494/10
(Continued)

FOREIGN PATENT DOCUMENTS

DE 69710861 T2 11/2002
DE 102004062231 A1 7/2006
(Continued)

OTHER PUBLICATIONS

United Kingdom Intellectual Property Office, Patents Act 1977: Combined Search and Examination Report under Sections 17 and 18(3), Application No. GB1606787.8, dated Nov. 17, 2016 (5 pages).
(Continued)

*Primary Examiner* — Walter D. Griffin
*Assistant Examiner* — Shuyi S. Liu
(74) *Attorney, Agent, or Firm* — Wood Herron & Evans LLP

(57) ABSTRACT

The present invention relates to a hybrid rotor for a centrifuge, in particular a laboratory centrifuge, comprising a rotor base body with a receptacle side and a drive side, means for fixing a drive shaft for rotating the hybrid rotor about a rotation axis (R), at least two receptacles with an insertion opening for centrifuge containers arranged on the receptacle side of the rotor base body, a rotary bearing for rotatably mounting a swinging container being formed on at least one receptacle and a fixed bearing for fixedly mounting a fixed angle container being formed on at least one receptacle. The present invention further relates to a set for a centrifuge, comprising a hybrid rotor and at least one fixed angle container. Furthermore, the present invention relates to fixed angle container for use in a hybrid rotor or in a set.

14 Claims, 4 Drawing Sheets

(52) U.S. Cl.
CPC ..... *B01L 9/06* (2013.01); *B01L 2200/02* (2013.01); *B01L 2300/0858* (2013.01)

(58) Field of Classification Search
USPC ..... 494/16, 20
See application file for complete search history.

(56) References Cited

U.S. PATENT DOCUMENTS

| | | | | |
|---|---|---|---|---|
| 4,586,918 | A * | 5/1986 | Cole | B04B 5/0421 494/20 |
| 4,801,290 | A | 1/1989 | Gunter | |
| 4,820,257 | A * | 4/1989 | Ishimaru | B04B 5/0414 494/16 |
| 4,941,867 | A * | 7/1990 | Tominaga | B04B 5/0414 494/16 |
| 5,362,300 | A | 11/1994 | Christensen | |
| 5,728,038 | A | 3/1998 | Coffey et al. | |
| 5,851,170 | A | 12/1998 | Howell | |
| 6,746,391 | B2 | 6/2004 | Lurz et al. | |
| 7,150,708 | B2 | 12/2006 | Lurz | |
| 2006/0183620 | A1* | 8/2006 | Eigemeier | B04B 5/0414 494/16 |
| 2010/0055698 | A1* | 3/2010 | Stibelli | B01L 3/502 435/6.13 |
| 2014/0179505 | A1 | 6/2014 | David et al. | |
| 2016/0310967 | A1 | 10/2016 | Henne et al. | |
| 2017/0050196 | A1* | 2/2017 | Sato | B04B 5/02 |

FOREIGN PATENT DOCUMENTS

| | | | | |
|---|---|---|---|---|
| DE | 102011050836 | A1 | 12/2012 | |
| GB | 2539757 | A | 12/2016 | |
| JP | 1-151850 | U | 10/1989 | |
| JP | 07047302 | A | 2/1995 | |
| WO | 9740942 | A1 | 11/1997 | |
| WO | WO 2008064783 | A1 * | 6/2008 | B01L 3/502 |
| WO | 2017112596 | A1 | 6/2017 | |

OTHER PUBLICATIONS

Espacenet, English Machine Translation of Abstract for DE102011050836A1, retrieved from http://worldwide.espacenet.com, published on Dec. 6, 2012 (1 page).

* cited by examiner

HYBRID ROTOR FOR A CENTRIFUGE, SET COMPRISING A HYBRID ROTOR AND A CENTRIFUGE CONTAINER, AND CENTRIFUGE CONTAINER

CROSS-REFERENCE TO RELATED APPLICATIONS

The present application claims priority under 35 U.S.C. § 119 of German Patent Application No. 10 2015 005 195.4, filed Apr. 23, 2015, the disclosure of which is hereby incorporated herein by reference in its entirety.

FIELD OF THE INVENTION

The present invention relates to a hybrid rotor for a centrifuge, in particular a laboratory centrifuge, comprising a rotor base body with a receptacle side and a drive side, means for fixing a drive shaft for rotating the hybrid rotor about a rotation axis, and at least two receptacles each having an insertion opening for a centrifuge container arranged on the receptacle side of the rotor base body. The present invention further relates to a set for a centrifuge, in particular a laboratory centrifuge, comprising a hybrid rotor and at least one fixed angle container. Furthermore, the present invention also relates to a fixed angle container for use in a hybrid rotor or in a set.

BACKGROUND OF THE INVENTION

The hybrid rotor, the set and the fixed angle container according to the present invention are configured for use in a centrifuge, particularly a laboratory centrifuge. Laboratory centrifuges are used for various applications in the biochemical, chemical, biological and medical fields, such as, for example, the separation of mixtures. To that end, a sample vessel containing the mixture to be separated is placed in a centrifuge container. In some cases, the sample vessel is accommodated in an adapter in advance. The centrifuge container is fixed to a rotor, which is in turn mounted on a drive head of a drive shaft of a centrifuge drive. The rotor of the centrifuge is rotated about a rotation axis by means of the drive, during which process the centrifugal forces acting on the samples cause the separation of the mixture. Laboratory centrifuges are different from industrially used centrifuges, for example, in that they often times operate with small sample volumes, and the samples may be very sensitive and valuable, requiring very precise devices which separate the samples most accurately without having a negative impact on the sample quality.

The present invention therefore primarily and preferably relates to laboratory centrifuges separating sample volumes up to 50 ml maximum, for example, up to 15 ml, at a capacity of up to 16 samples, in most cases up to 8 samples, at a time per run, and a centrifugal acceleration of 6,000 g maximum, for example, up to 4,000 times the gravitational acceleration (g).

It is known to mount the centrifuge containers together with the sample vessels in a suspended manner in the rotor such that said containers will swing outward into a horizontal position during the centrifuge run due to the centrifugal force. This type of sample container will hereinafter be referred to as "swinging container". Besides said swinging containers, centrifuge containers are known which are arranged in the rotor at a fixed angle relative to the rotation axis, which angle will not change during the centrifuge run. Such sample containers will subsequently be referred to as "fixed angle containers".

Since the swinging containers, respectively the fixed angle containers, each require different mounting in the rotor, two different types of rotors are conventionally used for the two applications. One example of a rotor configured for use with swinging containers is known from DE 10 2011 050 836 A1, a rotor for fixed angle containers is known from DE 10 2004 062 231 A1. Typically, in a centrifuge, either a rotor configured for use with swinging containers or a rotor configured for use with fixed angle containers may be fixed to the drive head depending on the application. Depending on the type of application currently required, the centrifuge needs to be re-equipped and the rotor has to be exchanged. This causes a time loss and costs. Moreover, often times the rotors have a complex structure and are expensive in manufacture. Due to strict safety regulations to be observed with respect to the rotors, they are also comparatively heavy, increasing the required rotational energy and the operating cost of the centrifuge.

SUMMARY OF THE INVENTION

It is thus the object of the present invention to provide solutions that enable improved handling of the centrifuge as well as reduce manufacturing and operating costs.

In particular, the object is achieved in the above mentioned hybrid rotor in that a rotary bearing for rotatably mounting a swinging container is formed on at least one receptacle and a fixed bearing for fixedly mounting a fixed angle container is formed on at least one receptacle. The term "hybrid rotor" thus refers to a centrifuge rotor configured to be suitable for both swinging container applications and fixed angle container applications when used with the respective centrifuge containers.

Swinging container applications are characterized in that a centrifuge container, in this case a swinging container, is mounted on the rotor in such a manner that it is moved from a hanging position into a swung-out position by a swinging movement during the centrifuge run. Here, the hanging position (usually vertical) or swung-out position (for example, horizontal or at any other angle greater than 0° and up to 90° relative to the hanging position) refers to the longitudinal axis of the centrifuge container. The swinging movement is caused by the centrifugal forces generated as a result of the rotation of the rotor. When the centrifuge run is finished and the centrifuge speed is reduced, the swinging container swings back into the hanging position from the swung-out position. The swinging angle is preferably limited to angular ranges below 90°, and is in the range of 85 to less than 90°, for example.

In contrast, fixed angle applications are characterized in that a centrifuge container, in this case a fixed angle container, is mounted in the centrifuge rotor in such a manner that its longitudinal axis has a fixed angle relative to the rotation axis of the centrifuge rotor. Said angle remains essentially the same during the entire centrifuge run and does not change. Preferably, the angle is in a range of 0° to 60°, in particular 25° to 50°, relative to the rotation axis.

Thus, in the context of the present invention, swinging container and fixed angle container refer to centrifuge containers that differ from each other. The differences between the two container types mainly consist in that the means for fixing the containers to the rotor differ from each other, enabling, on the one hand, swinging relative to the rotation axis of the rotor and, on the other hand, supporting the container on the rotor in a predetermined angle to the rotation axis, as described above.

The centrifuge containers, i.e., swinging or fixed angle containers, are mounted in receptacles in the hybrid rotor. The receptacles comprise in each case insertion openings through which the centrifuge containers can be inserted into the receptacles. The side of the rotor base body from which the centrifuge containers are inserted into the receptacles is called the receptacle side of the rotor base body or of the hybrid rotor. The drive side of the rotor base body or the hybrid rotor is preferably located opposite the receptacle side. The drive shaft of a centrifuge motor can be fixed to the drive side of the rotor base body, for example, via a drive head. During the centrifuge run, the hybrid rotor is rotated via the drive shaft and the centrifuge motor.

According to the present invention, it is provided that—contrary to the prior art—there is no longer a need to use a separate centrifuge rotor for swinging container applications and fixed angle container applications, but a hybrid rotor which is suitable for both applications at once. According to the present invention, both a rotary bearing, on which a swinging container may be supported, and a fixed bearing, on which a fixed angle container may be supported, are provided on one single centrifuge rotor. Rotary bearing in this respect refers to any component or any structure of the hybrid rotor capable of both mounting a swinging container and ensuring that the swinging container can swing outward from a hanging position into a swung-out position during the centrifuge run. Fixed bearing in this respect refers to any structure and any component of the hybrid rotor which mounts a fixed angle container in the receptacle of a hybrid rotor in such a manner that the fixed angle container maintains with its longitudinal axis an essentially constant angle relative to the rotation axis during the entire centrifuge run. Thus, the fixed bearing particularly serves for preventing the fixed angle container from swinging, whereas this is explicitly allowed by the rotary bearing. By the use of a hybrid rotor according to the present invention, both manufacturing costs and acquisition costs for two different rotors for the respective applications are dispensed with. Furthermore, the hybrid rotor need not be exchanged in the case that two centrifuge runs are to be performed one after the other, each with a different application. In this respect, the time for re-equipping the centrifuge is saved as well, which results in more cost-effective operation of the centrifuge having a hybrid rotor according to the present invention compared to conventional centrifuge rotors. In addition, both swinging containers and fixed angle containers can be processed together during one centrifuge run. It is thus possible to determine by mere selection of the containers whether the rotor according to the present invention is to be operated as a swinging container rotor and/or as a fixed container rotor.

It is possible to provide in each case different receptacles on the hybrid rotor, the one receptacle comprising a rotary bearing and the other receptacle comprising a fixed bearing. Both receptacle types are expediently situated on the receptacle side of the rotor. In such a hybrid rotor, the respective receptacles are configured either for a swinging container application or a fixed angle container application. This way, using swinging containers and fixed angle containers together in one centrifuge run is in fact possible, however the maximum capacity for one type of centrifuge container, i.e., either fixed angle containers or swinging containers, is significantly limited. It is therefore preferred for at least one receptacle, preferably all receptacles, to have both a rotary bearing and a fixed bearing. The respective receptacles are thus configured for both the application with a swinging container and the application with a fixed angle container. Ideally, all receptacles of the hybrid rotor are suitable for both applications. As a result, the hybrid rotor may be operated both with a maximum number of swinging containers or with a maximum number of fixed angle containers or any mixture of the two container types. The capacity of the hybrid rotor for one container type is thus not limited compared to a conventional rotor which is configured only for this container type.

The rotary bearing according to the present invention can be configured in different manners and basically like any bearing for swinging containers known from the prior art. For example, the rotary bearing may comprise two trunnions which are arranged opposite each other and which protrude outwards, on which a swinging container having correspondingly complementary formed recesses or projections may be suspended. What is important is that the rotary bearing forms at least one fixed counter bearing on the rotor, in which at least a part of the swinging container can be rotatably mounted. In a preferred embodiment, the rotary bearing comprises two recesses for receiving one respective trunnion of a swinging container, which recesses are arranged opposite each other at the insertion opening and are particularly rounded. Such recesses can be formed in the rotor base body in a particularly simple manner and thus promote low production cost of the hybrid rotor. As a result, the hybrid rotor is configured particularly for use with swinging containers having two trunnions arranged opposite each other. The trunnions may be fixedly connected to the swinging container. Then, the swinging movement is effected by rotation of the trunnions in the recesses of the rotor. Appropriately, the contours of the trunnions and recesses are rounded in this case. As an alternative, the trunnions may be rotatably mounted on the swinging container, wherein in this case the trunnions are preferably received in the recesses in a non-rotatable manner and their contours are configured to have an angular shape accordingly.

The fixed bearing may basically just as well have various different shapes. It is possible, for example, that the fixed bearing comprises protrusions, recesses or undercuts which a complementary-formed part of the fixed angle container engages. It is also conceivable to provide fixing means to the hybrid rotor, by means of which the fixed angle container can be hooked, clamped or latched, for example. However, according to one embodiment of the present invention, fixed bearings are preferred that have a simple structure and that are characterized by quick handling and high reliability. It is particularly preferred that the fixed bearing comprises a planar, preferably flat, support for receiving a collar of a fixed angle container, the support being arranged around the insertion opening of a receptacle on the receptacle side of the rotor base body and preferably completely surrounding the insertion opening laterally. The planar support of the fixed bearing serves as a support surface for a collar on the fixed angle container and is particularly configured as a recess in the rotor base body so that it can, particularly completely, receive the collar of a fixed angle container. A complete reception of the collar means that said collar resting against the planar support of the fixed bearing does not protrude from the rotor base body. As a result of the fact that the collar rests against the planar support, tilting of the fixed angle container is prevented in the receptacle. Instead, the fixed angle container is maintained with its longitudinal axis at a fixed angle relative to the rotation axis of the hybrid rotor by the planar support at its collar. When the planar support completely surrounds the insertion opening laterally, a particularly stable support of the fixed angle container is achieved. Due to the described configuration of the fixed bearing, the fixed angle container merely needs to be inserted into the receptacle until the collar rests on the planar support of the fixed bearing. As a result, the fixed angle container can be mounted on and removed from the hybrid rotor in a very quick fashion. Accordingly, operation effort is reduced.

In order to use the available area on the receptacle side of the hybrid rotor in a most efficient manner, it is advantageous if the planar supports of the fixed bearings are located as close to one another as possible. Therefore, it is expedient if the planar supports of the fixed bearings are arranged around the rotation axis in such a manner that no unused area remains between the individual fixed bearings. It is therefore preferred that the planar supports of multiple fixed bearings are arranged directly next one another in the direction of rotation such that they form a ring with the rotation axis being arranged in the center of said ring. The ring does not have to be an exact circular ring but may also be formed by polygonal planar supports or polygonal fixed bearings. The fixed bearings annularly arranged around the rotation axis utilize the area available on the receptacle side of the hybrid rotor in an optimum manner. As a result, the rotor does not need to be greater than absolutely required, which is why relatively low rotation energy for driving the hybrid rotor is sufficient and operating cost is reduced.

The planar support of the at least one fixed bearing can be in the horizontal plane, for example, i.e., forming a right angle relative to the rotation axis of the hybrid rotor. However, inclining the planar support of the at least one fixed bearing from the drive side of the hybrid rotor toward the rotation axis corresponding to the inclined position of the fixed angle container is a more ergonomic solution. Thus, the hybrid rotor altogether forms a concave recess at the receptacle side with the rotation axis in the center. In such an inclined configuration of the fixed bearing, forces occurring on the fixed angle container during operation may particularly well be deflected into the hybrid rotor, which increases the stability of the hybrid rotor and the containers as well as safety during the centrifuge run.

The outer contour of the planar support can be configured in various ways. Optimum utilization of the available area is achieved in that the planar support of the at least one fixed bearing is designed in a trapezoid shape. In this case, the shorter base side of the trapezoid is oriented towards the rotation axis of the hybrid rotor. The insertion opening of the receptacle of the hybrid rotor is located approximately in the center of the trapezoid support. Ideally, the insertion opening is enclosed by the support of the fixed bearing at the entire periphery thereof. By means of optimum utilization of the available space, a maximum support area on the fixed bearing is used for the collar of the fixed angle container. This results in a particularly low force per area to be transferred from the fixed angle container to the hybrid rotor during the centrifuge run. This ensures a stable and safe operation.

The arrangement of the fixed bearing relative to the rotary bearing is also variable. For example, it is possible to arrange the rotary bearing in front of the fixed bearing viewed from the receptacle side. As a result, the rotary bearing would be elevated compared to the fixed bearing on the receptacle side of the hybrid rotor. However, such a configuration would result in the problem that if the rotary bearing has a stable structure, the neighboring fixed bearing would have less available support area, or, vice versa, the rotary bearing would have to be configured comparatively instable in order to make more space available for the fixed bearing. Therefore, it is preferred to arrange the fixed bearing in front of the rotary bearing viewed from the receptacle side. In other words, the recesses of the rotary bearing are arranged in the region of the planar support of the fixed bearing and sunk into said support, preferably directly laterally adjacent to the insertion opening. The remaining lateral edge sections of the rotary bearing recesses are preferably surrounded by the support surface of the fixed bearing. Such an arrangement of the fixed bearing and the rotary bearing relative to one another can be manufactured in a structurally simple manner, has a compact structure and furthermore enables a particularly stable support of both a swinging container in the rotary bearing and a fixed angle container in the fixed bearing.

The object underlying the present invention is also achieved by a set for a centrifuge, particularly a laboratory centrifuge, comprising a hybrid rotor as described above and at least one fixed angle container. Moreover, the set may of course also include one or more swinging containers. In total, the set thus consists of the above described items, which is why all of the above-mentioned features and advantages of the respective components also apply to the set as a whole. The following description of the set is provided particularly for explaining the interplay between the hybrid rotor and fixed angle and swinging containers.

The fixed angle container needs to have a structure that interacts with the fixed bearing of the hybrid rotor such that the fixed angle container in the receptacle is prevented from swinging during the centrifuge run. The exact configuration of said structure is less important. However, it turned out to be advantageous if the at least one fixed angle container comprises a collar which is designed complimentary to the planar support of the fixed bearing of the hybrid rotor, and in particular in the shape of a trapezoid, so that it rests against the support of the fixed bearing in a form-fitting manner such that the fixed angle container is prevented from swinging. In particular, the collar is also configured planar and/or flat. Preferably, according to one embodiment, it protrudes from the base body of the fixed angle container in the radial direction viewed from the longitudinal axis of the fixed angle container and is particularly oriented perpendicular to the longitudinal axis of the fixed angle container. By means of said shape, it is possible that the collar rests on the planar support of the fixed bearing with a maximum area and can deflect forces acting on the fixed angle container during a centrifuge run in a most uniform manner over the entire area of the collar into the hybrid rotor. This configuration is characterized by particularly stable centrifuge runs and long service lives of both the hybrid rotor and the fixed angle container.

Another aspect of the present invention relates to the use of the recess of the rotary bearing for additionally supporting the fixed angle container. If the fixed angle container has only a collar resting on the planar support of the fixed bearing, the recess of the rotary bearing will remain empty and constitute a hollow space below the collar in the hybrid rotor. Since such a hollow space is disadvantageous for the stability of the construction as, for example, forces cannot be deflected from the fixed angle container into the hybrid rotor via the hollow space, it is advantageous if the fixed angle container has a structure filling the recess of the rotary bearing. It is thus preferred that the at least one fixed angle container comprises trunnions which are configured complementary to the recesses of the rotary bearing of the hybrid rotor and rest in the recesses of the rotary bearings of the hybrid rotor. A trunnion basically has the same shape as a trunnion of a swinging container. However, it is also possible that the trunnion has the shape of only a part of a trunnion of a swinging container. For example, the trunnion of the fixed angle container may include only the part which fills the recess of the rotary bearing. Parts of the trunnion of the swinging container which project from the recess of the rotary bearing may be omitted in the trunnion of the fixed angle container. By means of said trunnion, which ideally completely fills the recess of the rotary bearing, forces can also be transferred from the fixed angle container to the hybrid rotor in this embodiment. The fixed angle container thus also rests against the rotary bearing, however without being rotatable in said bearing. The trunnions of the fixed angle container serve as an additional support and stabilize the support of the fixed angle container on the hybrid rotor.

A conceivable alternative configuration may consist in conversion of a swinging container to a fixed angle container by subsequently securing it to the rotor using a locking means. The locking means may, for example, be a locking plate which, instead of a collar fixedly connected to the container, is placed into the fixed bearing and onto the upper end of the swinging container when the latter is already situated in the rotor, in order to fix the swinging container in the rotor at a predetermined angle. However, due to the larger number of parts, which complicate the handling, and the less stable mounting in the rotor, this variant is currently not preferred. Thus, swinging containers and fixed angle containers preferably differ from each other per se already outside the rotor. Whether the rotor according to the present invention is operated as a swinging container rotor and/or as a fixed angle container rotor depends on the selection of the containers.

In order to minimize the rotation energy required for driving the rotor, it is basically advantageous to configure the rotor as light as possible. The lower the rotation energy, the lower the motor power required for operating the rotor, and the lower the demands for passive safety in the case of a rotor break. Thus, lower rotation energy comes with an increased passive safety of the apparatus, and the energy consumption when accelerating, rotating and decelerating the rotor decreases. Furthermore, costs may be saved because of the low material effort when manufacturing the rotor. Furthermore, handling of a lighter rotor is more comfortable for the user and reduces the effort when exchanging the rotor, which in turn will rarely be required in the case of the present invention, since both swinging and fixed angle container applications can be effected by means of the rotor according to the present invention.

The rotor according to the present invention preferably basically corresponds to that of a swinging container rotor. These are usually smaller and lighter than fixed angle container rotors, since the centrifuge containers are usually received in the rotor only in part, i.e., with the part comprising the suspension devices, while the free ends of the containers protrude from the rotor. The hybrid rotor according to the present invention is expediently also configured in this way and thus has a comparatively small diameter, which is sufficient for ensuring a safe suspension of the centrifuge container. While the receptacle side of the rotor is configured to be relatively compact and essentially only comprises the insertion openings for the centrifuge containers, the drive side of the rotor is comparatively open, since the receptacle openings, through which the swinging containers swing outwards from the hanging position into the swung-out position, extend in this region. For this purpose, slot-like openings, into which the swinging containers swing during rotation, are also present in the outer periphery of the rotor. The hybrid rotor according to the present invention is already very light because of said open structure.

Further weight savings can be achieved by suitable selection of materials. According to one embodiment of the present invention, it is preferred to produce the hybrid rotor from a plastic. Particularly preferably, an injection-moldable plastic is used which allows manufacturing the rotor by injection-molding. Fiber-reinforced plastics may be used which increase the break resistance of the rotor. Suitable plastics are, inter alia, polyolefins such as in particular polypropylene. The manufacture by means of injection molding works particularly well in the case of rotors having a simple structure with smooth and little-winding surfaces. Further weight savings are possible by means of additional hollow spaces in the rotor base body, where a sufficient stability of the remaining structure is to be observed however.

An increased stability of the rotor can be achieved by the interplay of the rotor with the centrifuge containers. The centrifuge containers are in this case configured such that they contribute to a stabilization of the rotor particularly during the rotation by counteracting a deformation of the rotor. Due to the preferred light-weight construction of the rotor according to one embodiment of the present invention, deformations may occur particularly in the region of the outer periphery at high rotational speeds. Said deformations cause imbalances during the rotation, for example, and may lead to a break of the rotor in the worst case. Thus, according to one embodiment of the present invention, the centrifuge containers and particularly the fixed angle containers comprise means which prevent or at least reduce a spreading of the rotor in the region of its outer periphery. Specifically, the centrifuge container comprises two locking protrusions engaging into corresponding recesses on both sides of a rotor receptacle, undercutting said recess. Appropriately, the undercuts are located in the outer peripheral region of the rotor. Thus, the locking protrusions of the centrifuge container hold the regions of the rotor enclosing the receptacle together in a clamp-type manner and thus prevent a spreading during the rotation operation. This way, the service life and the safety of the hybrid rotor are improved.

As described above, the rotor according to one embodiment of the present invention is preferably constructed such that the centrifuge containers protrude from the outer periphery of the rotor with their free ends. This increases the air resistance during rotation compared to a fixed angle rotor compactly enclosing the centrifuge containers. In order to counteract this, the centrifuge containers and in particular the swinging containers include devices for reducing the air resistance located on their free ends protruding from the rotor periphery. In particular, these devices are protrusions projecting in the direction of rotation beyond the outer periphery of the centrifuge container in a wedge-type manner, dividing the air stream and guiding said stream past the sides of the centrifuge container.

The present invention also relates to a fixed angle container for use in a hybrid rotor or in a set, as described above. The features and advantages of the fixed angle container already mentioned above apply accordingly. The fixed angle container is characterized in that it comprises a swinging container with a detachable adapter arranged thereon, the adapter comprising a collar configured complementary to a fixed bearing of a hybrid rotor. In other words, the fixed angle container according to the present invention can be converted into a swinging container by removing the adapter or, vice versa, be converted from a swinging container into a fixed angle container by attaching the adapter. For example, the swinging container corresponds to a normal swinging container with trunnions for resting in the rotary bearing of the hybrid rotor. The detachable adapter comprises the additional features of the fixed angle container, above all the collar, and can be detachably attached to the swinging container. The swinging container with the adapter mounted corresponds to a fixed angle container in which the collar of the adapter rests against the fixed bearing of the hybrid rotor, preventing the fixed angle container from swinging in the receptacle of the hybrid rotor. By means of using such a fixed angle container, there is no need to acquire two different centrifuge containers for each application, which allows a further reduction of the costs.

BRIEF DESCRIPTION OF THE DRAWINGS

The present invention will be described in greater detail below with reference to the exemplary embodiments shown in the figures. In the schematic figures.

Like reference numerals refer to like components in all figures. Not each of the components is separately indicated in each of the drawings.

DETAILED DESCRIPTION OF THE INVENTION

Figure 1:
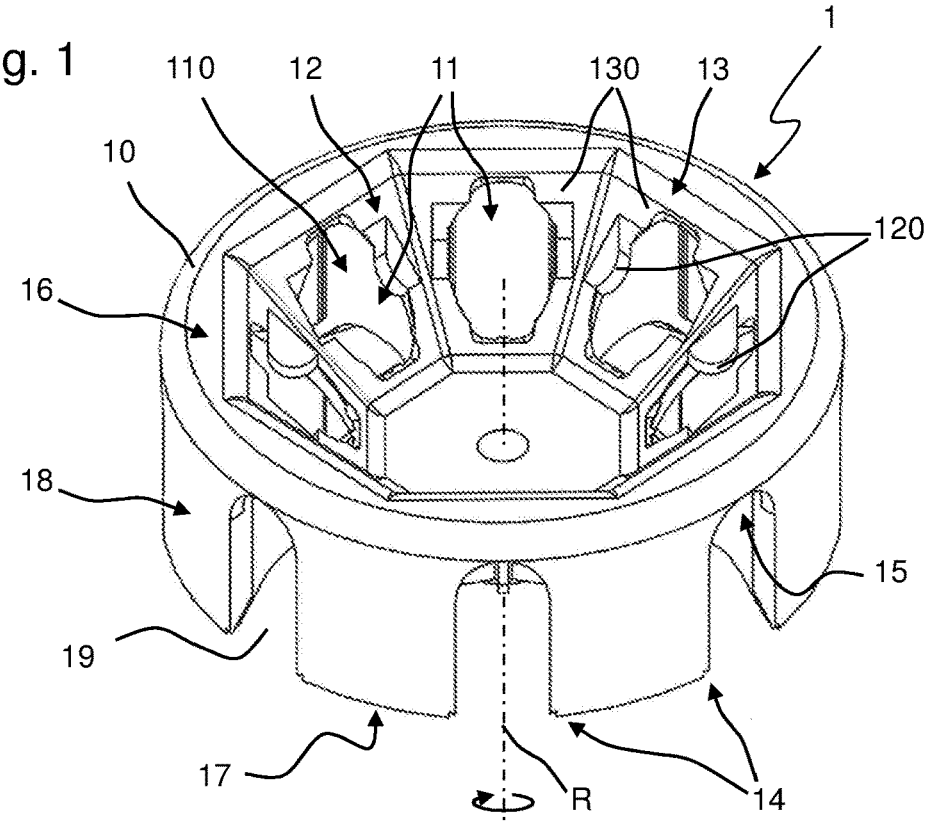
FIG. 1 is a perspective view of a hybrid rotor according to the present invention from obliquely above onto the receptacle side.

FIG. 1 shows a hybrid rotor 1 having a rotor base body 10. The hybrid rotor 1 or the rotor base body 10, respectively, comprises a receptacle side 16, a drive side 17 and a lateral surface 18. The hybrid rotor 1 can be mounted on a drive head of a drive shaft of a centrifuge motor (not shown) and is configured for rotation about the rotation axis R. Central elements of the hybrid rotor 1 are the rotary bearings 12 with recesses 120 and the fixed bearings 13 with supports 130.

Each receptacle 11 is assigned one rotary bearing 12, which is formed by two recesses 120 located opposite each other on both sides of the insertion openings 110 of the receptacles 11. The recesses are oriented such that the pivot axis of a swinging container 2 mounted in the rotary bearing 12 is a tangent of a circle the center point of which is on the rotation axis R. Furthermore, the rotary bearings 12 are configured such that they securely hold the swinging containers 2 in the receptacles 11 in any swinging position between the vertically hanging position and the essentially horizontal swung-out position. The recesses 120 are configured to be open toward the receptacle 11 in order to be able to receive the lateral trunnions 23 of the swinging containers 2. Furthermore, the recesses 120 are configured as rounded in order to guide the swinging movement of the swinging containers 2 most continuously, smoothly and free of shocks. This way, even sensitive samples can be centrifuged without a negative impact on their quality.

In the embodiments shown, each receptacle 11 comprises a fixed bearing 13. The fixed bearing 13 has a planar support 130 arranged around the insertion opening 110 of the receptacle 11 and completely surrounding said receptacle. In the present case, the planar support 130 is formed as a recess on the rotor base body 10. It covers a maximum possible and particularly even area. By means of the maximum sized counter-bearing for the fixed angle containers 3, the forces to be transferred from the containers to the hybrid rotor 1 are distributed in the best possible manner. The recessed planar support 130 is configured such that a collar 34 (FIG. 3) of a fixed angle container 3 can be placed therein. The planar supports 130 slope down from the receptacle side 16 to the rotation axis R and the drive side 17. A number of supports 130 are located next to one another arranged around the rotation axis R in an annular manner such that there is no remaining interspace between the supports 130. In order to utilize the surface of the receptacle side 16 of the hybrid rotor 1 in the most efficient manner, the supports 130 are configured in a trapezoid form.

The rotary bearings 12 with their recesses 120 are formed in the region of the fixed bearings 13 and their planar support 130. The edges of a recess 120 are thus directly surrounded by the insertion opening 110 of the associated receptacle 11 on the one hand and by the planar support 130 of the fixed bearing 13 on the other hand. Thus, viewed in the insertion direction of the centrifuge containers 2, 3 in the receptacles 11, the rotary bearings 12 are located behind the fixed bearings 13.

Figure 2:
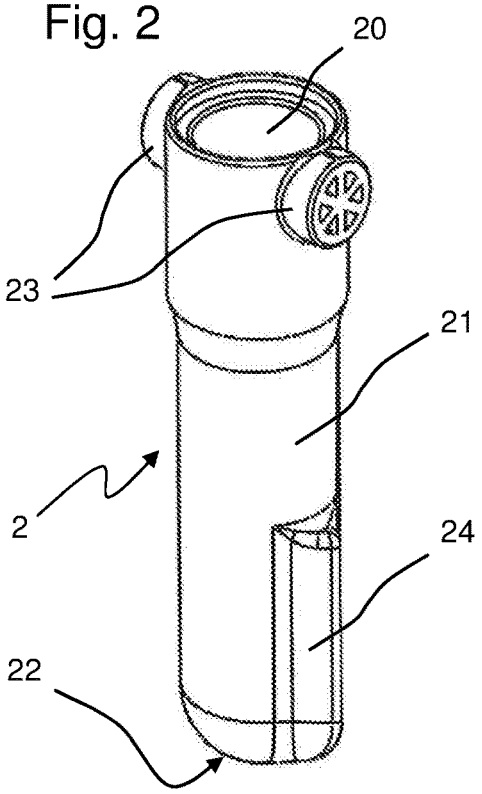
FIG. 2 is a perspective view of a swinging container.
Figure 4:
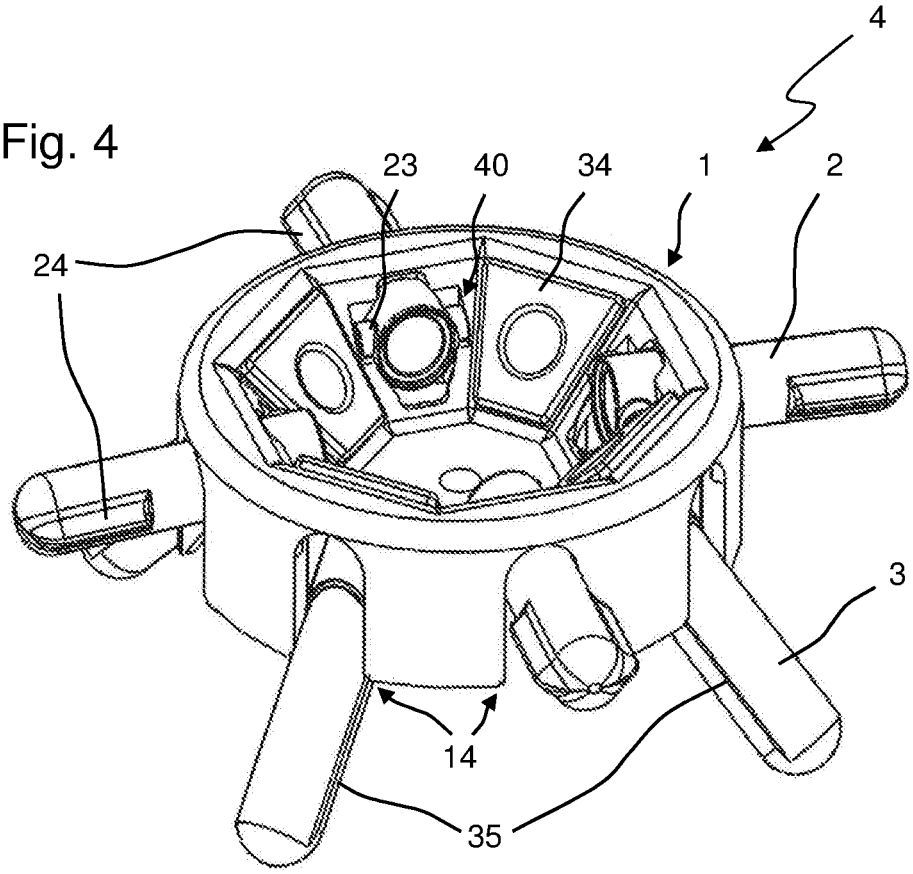
FIG. 4 shows a hybrid rotor with a mixture of swinging and fixed angle containers.
Figure 5:
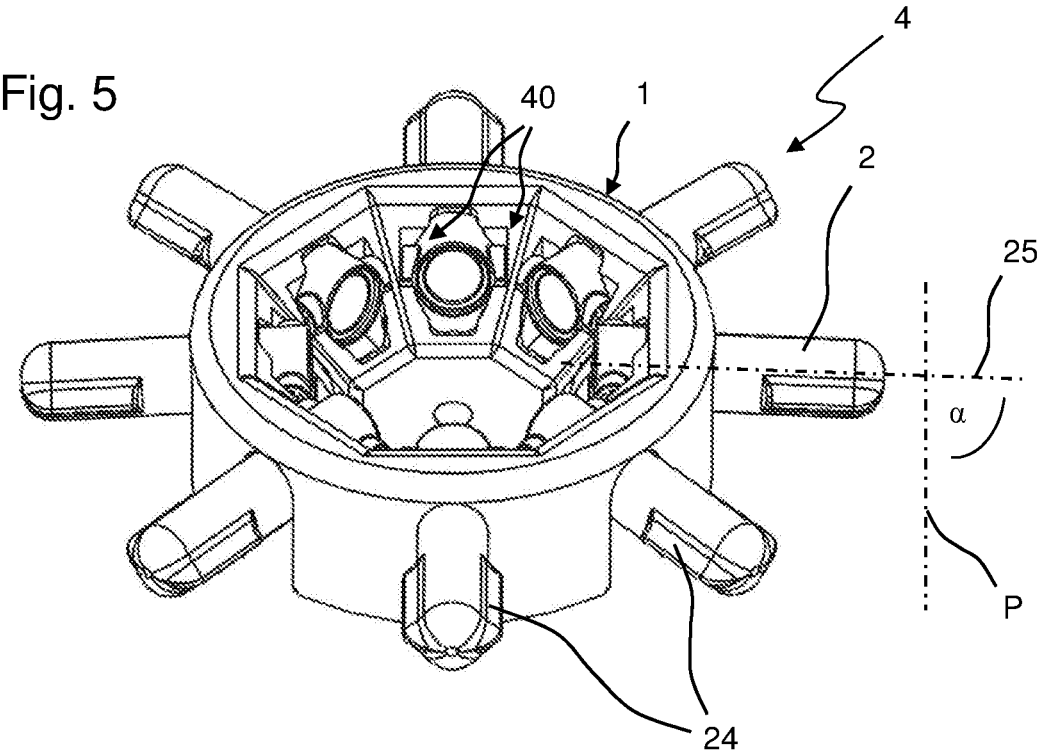
FIG. 5 shows a hybrid rotor operated with swinging containers.

FIG. 2 shows a swinging container 2. The swinging container 2 includes a base body 21 and an opening 20 through which a sample vessel (not shown) can be inserted into the swinging container 2. On the end opposite the opening 20, the swinging container 2 comprises a vessel bottom 22. For support in the rotary bearing 12, it further comprises two trunnions 23 configured complementary to the recesses 120 of the rotary bearing 12. The trunnions 23 of the swinging container 2 have a spoke wheel structure in the embodiment shown, which structure ensures high stability on the one hand and low material consumption, light weight and cost-effective manufacture on the other hand. The swinging container 2 can be suspended in the recesses 120 of one of the rotary bearings 12 with the trunnions 23. At a standstill of the hybrid rotor 1, the swinging containers 2 are suspended in the receptacles 11 so as to hang down with their longitudinal axis 25 essentially parallel to the rotation axis R. When the hybrid rotor 1 is rotated, the swinging containers 2 swing outwards into an essentially horizontal position as shown in FIGS. 4 and 5, for example. However, the openings 19 in the lateral wall 18 could also be configured shorter, which would reduce the swing angle $\alpha$ to less than 90°.

Figure 3:
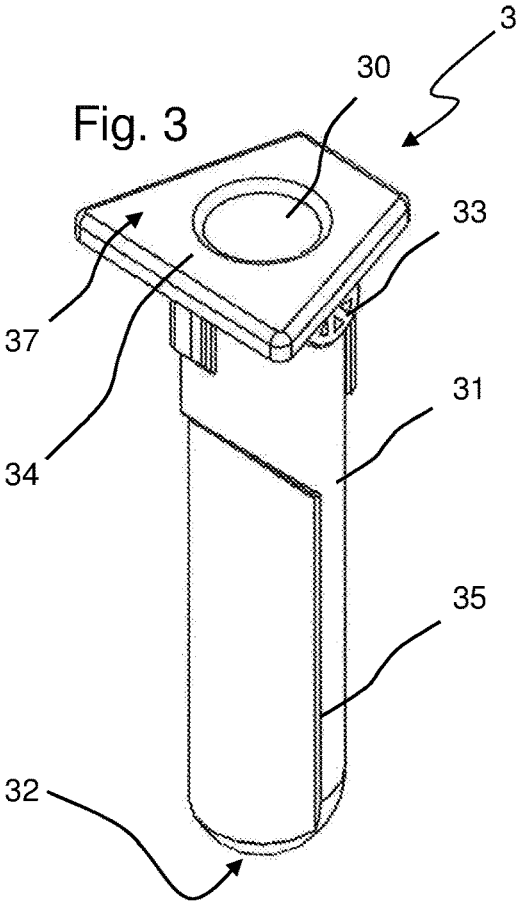
FIG. 3 is a perspective view of a fixed angle container.

A fixed angle container 3 according to one embodiment of the present invention is illustrated in FIG. 3. The fixed angle container 3 includes a base body 31 with a vessel bottom 32 and an opening 30 opposite the vessel bottom through which sample vessels (not shown) can be inserted into the fixed angle container 3. Moreover, the fixed angle container 3 comprises a collar 34 by means of which it rests against the fixed bearing 23 of the hybrid rotor 1 when received in a receptacle 11. In the present exemplary embodiment, the collar 34 is configured as a plate arranged as trapezoid and perpendicular to the longitudinal axis 36 of the fixed angle container 3. The collar 34 completely surrounds the opening 30 in the radial direction viewed from the longitudinal axis 36 of the fixed-angle container 3. When the fixed angle container 3 is inserted in the receptacle 11, the collar 34 prevents a tilting or swinging of the fixed angle container 3, so that the fixed-angle β does essentially not change during the entire centrifuge run. Further, the fixed angle container 3 comprises trunnions 33 which, like the trunnions 23 of the swinging container 2, are configured complementary to the rotary bearing 12 of the hybrid rotor 1. When the fixed angle container 3 is inserted in the receptacle 11 of the hybrid rotor 1, the trunnions 33 completely fill the recesses 120 of the rotary bearing 12. Here, the trunnions 33 of the fixed angle container 3 do not have to completely correspond to the trunnions 23 of the swinging container 2; it is sufficient if the trunnions 33 of the fixed angle container 3 merely entirely fill the recesses 120 of the rotary bearing 12 and do not protrude from the recesses 120 of the rotary bearing 12. By means of the trunnions 33, forces acting on the fixed angle container 3 during the centrifuge run can be transferred onto the hybrid rotor 1 also at the position of the rotary bearing 12.

A swinging container can be generated from the fixed angle container 3 shown in FIG. 3 if the upper region comprising the collar 34 is configured as a detachable adapter 37. The adapter may be detachably connected to the swinging container in any suitable manner, for example, by means of latch, plug, or bayonet connections. The fixed angle container 3 shown in FIG. 3 can thus be converted into a swinging container 2 similar to the one shown in FIG. 2 by removal of the adapter 37. The collar 34 of the adapter 37 corresponds to the collar 34 of the integrally formed fixed angle container 3 described above. By means of using such an adapter, there is no need to acquire two different centrifuge containers 2, 3 in order to be able to use the hybrid rotor 1 in both swinging container and fixed angle container applications. The use of the adapter 37 or the fixed angle container 3 with the adapter 37 thus reduces the acquisition costs for the customer and the manufacturing costs for the different centrifuge containers 2, 3.

The hybrid rotor 1, the swinging containers 2 and the fixed angle containers 3 are preferably manufactured from a plastic by means of injection-molding. For example, polypropylene turned out to be a particularly suitable material. Preferably, a fiber-reinforced plastic material such as polypropylene reinforced with glass-fibers and/or carbon fibers is used for the rotor. Such materials are very durable and can be cleaned in a simple and reliable manner. Furthermore, they are very light, so that the centrifuge has low energy consumption during acceleration and deceleration. The lower rotation energy reduces the safety efforts when constructing the centrifuge which is to use the hybrid rotor, since less rotation energy needs to be decelerated in a case of emergency in a break of the hybrid rotors 1. All in all, safety of the centrifuge is increased. Moreover, the manufacture by means of injection-molding is very simple and as well allows producing greater quantities in a cost-efficient manner.

As can be seen from FIGS. 1 and 4 to 6, for example, the receptacle side 16 of the hybrid rotor 1 comprises receptacles 11 into which, coming from the receptacle side 16, the centrifuge containers 2, 3, i.e., swinging containers 2 and fixed angle containers 3, can be inserted via the insertion opening 110. Rotary bearings 12 having recesses 120 are provided for mounting swinging containers 2 on the hybrid rotor 1. Moreover, the hybrid rotor 1 additionally comprises fixed bearings 13 in each receptacle 11 which have planar supports 130 for receiving fixed angle containers 3. The interplay between the hybrid rotor 1 and the swinging containers 2 and/or fixed angle containers 3 in a set 4 can particularly be taken from FIGS. 4, 5 and 6. As can be taken from the figures, the hybrid rotor 1 can be operated either exclusively with swinging containers 2 (FIG. 5), exclusively with fixed angle containers 3 (FIG. 5) or in a mixed operation (FIG. 4). The figures illustrate the swinging containers 2 in the swung-out, here essentially horizontal position. The trunnions 23 by means of which the swinging containers 2 are rotatably mounted in the recesses 120 of the rotary bearings 12, form a rotary joint 40 together with the latter. The rotary joint 40 enables a continuous and smooth swinging of the swinging containers 2 within the receptacle 11.

Figure 7:
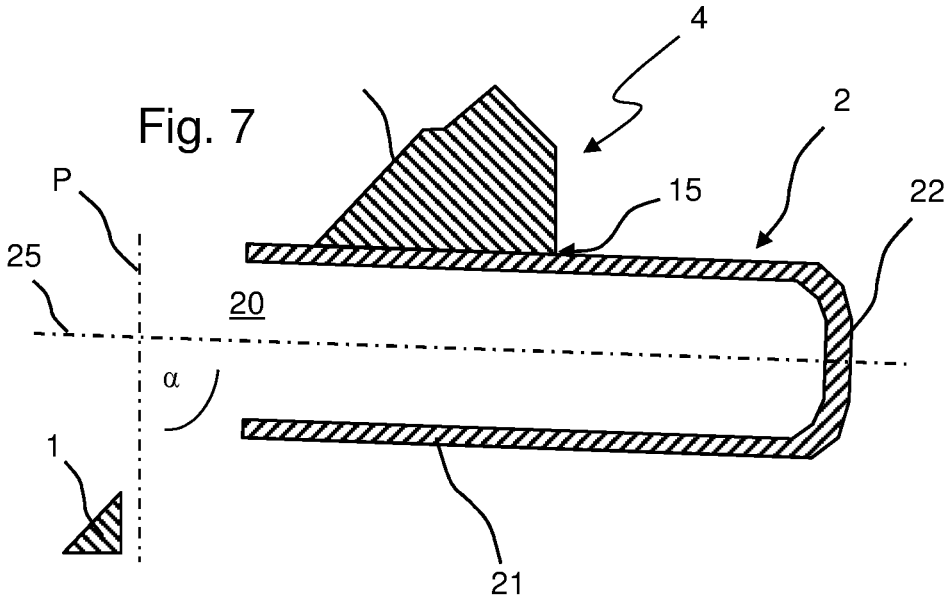
FIG. 7 shows a longitudinal section through a swinging container in operation with a hybrid rotor.

As can particularly be seen from FIGS. 5 and 7, the swinging containers 2 swing outward into a swing angle α between their longitudinal axis 25 and a parallel P to the rotation axis R. The swing angle α is smaller than or equal to 90°. Besides the rotary joint 40, the swinging containers 2 have an additional contact on the hybrid rotor 1 at least in the swung-out position and are stabilized by said contact. FIG. 7 shows a vertical longitudinal section along the longitudinal axis 25 of the swinging container 2 in a swung-out position, where the cut portions of the hybrid rotor 1 are also shown. As can be taken from FIG. 7, the hybrid rotor 1 comprises a stop 15, which the swinging container rests against during operation of the hybrid rotor 1 in a centrifuge. Thus, the position of the stop 15 decisively determines the swing angle α. It is preferred according to one embodiment of the present invention that the stop 15 is configured such that the swing angle α is smaller than 90°. Preferably, the swing angle α is between 85° and less than 90°, and particularly preferably is 88°. In said ranges, the swinging container 2 rests against the stop 15 of the hybrid rotor 1 such that a part of the centrifugal force acting on the swinging container 2 can be transferred into the hybrid rotor via the stop 15, relieving the rotary joint 40 or the parts thereof, i.e., the trunnions 23 and the rotary bearing 12. By relieving the rotary joint 40, its service life is increased.

Furthermore, the swinging container 2 comprises fins 24. The fins 24 are located on the same sides of the swinging container 2 as the trunnions 23. Thus, the fins 24 are arranged in the direction of rotation of the hybrid rotor 1 and also of the swinging container 2 thereon. They have a radially outwardly tapering shape viewed from the longitudinal axis 25 and extend from the vessel bottom 22 parallel to the longitudinal axis 25 over the portion of the swinging container 2 that is not located inside the hybrid rotor 1 during a centrifuge run. All in all, the fins 24 extend over at least a third and preferably over half of the longitudinal extension of the swinging container 2. They serve for making the swinging container 2 more aerodynamic. By using the fins 24, the friction loss of the container is reduced by about 20% in operation of the centrifuge, which also requires a lower motor power and reduces air noise development. Even if the fins 24 protrude laterally from the width of the openings 110 and 19, the swinging containers can easily be inserted in the receptacles 11 and removed therefrom by rotating the containers such that the fins stand approximately upward and downward while located in the region inside the rotor. In the example shown, only the swinging containers comprise fins, however the latter can also be provided on the fixed angle containers.

Figure 6:
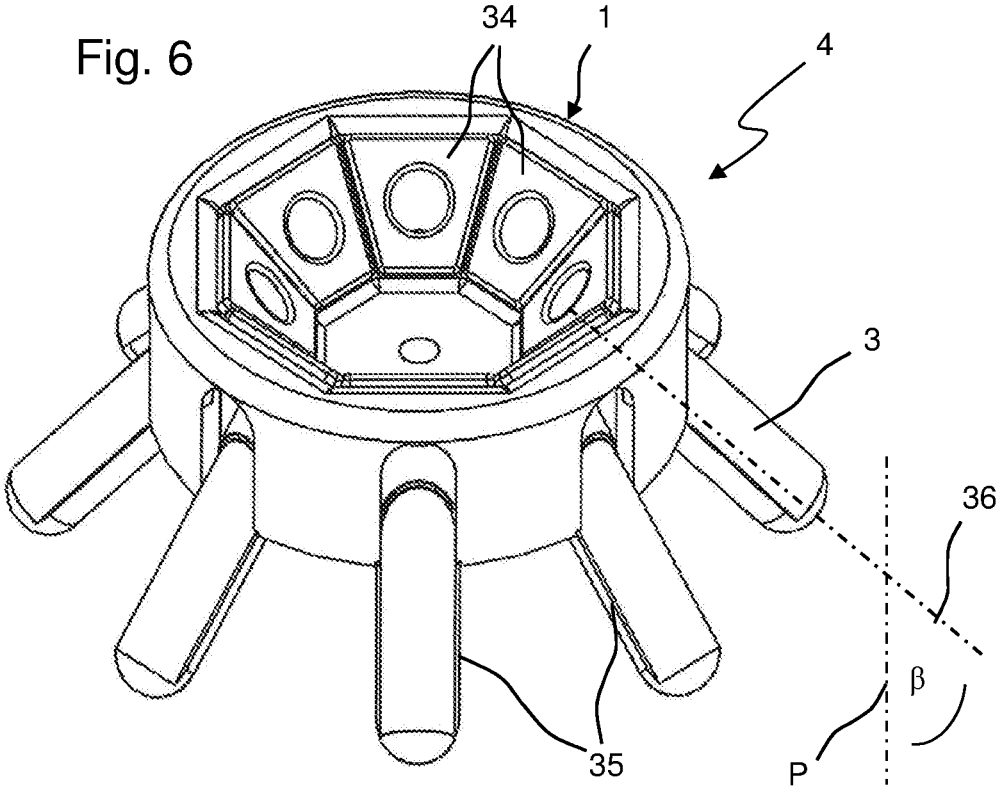
FIG. 6 shows a hybrid rotor operated with fixed angle containers.

As can particularly be seen from FIGS. 4 and 6, the fixed angle containers 3 are mounted in the receptacles 11 in such a way that their collar 34 (FIG. 3) rests on the planar support 130 at the fixed bearing 13. In said position, the longitudinal axis 36 of the fixed angle container 3 encloses a fixed angle β with the parallel P to the rotation axis R. Said fixed angle β does essentially not change during the entire centrifuge run but remains constant since the collar 34 prevents the fixed angle containers 3 in the receptacles 11 from swinging.

Figure 8:
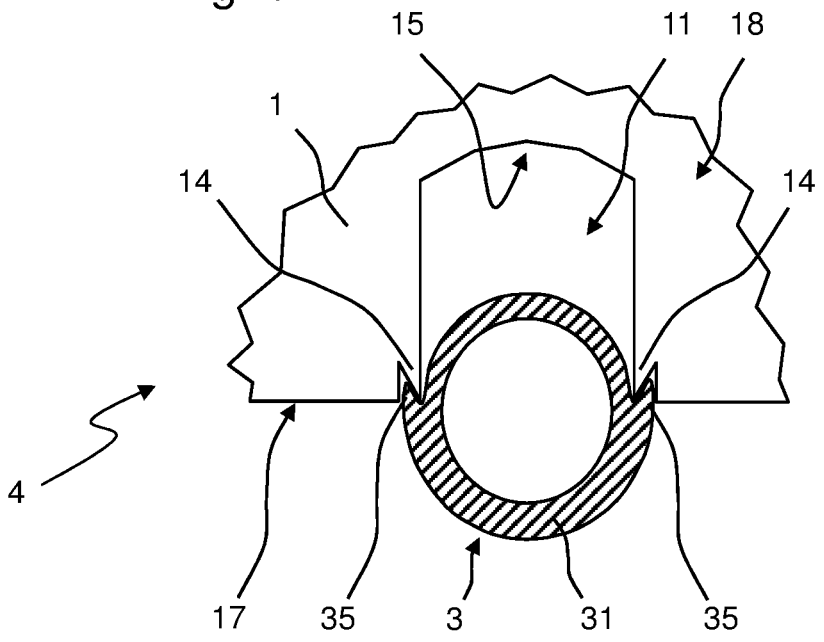
FIG. 8 shows a cross-section through a fixed angle container in operation with a hybrid rotor.

Furthermore, the fixed angle container 3 comprises locking protrusions 35, the function of which is explained in greater detail in FIG. 8. FIG. 8 illustrates a view of the lateral surface 18 of a hybrid rotor 1 when operated with a fixed angle container 3, which is shown in the cross-section perpendicular to its longitudinal axis 36 here. Undercuts 14 are located on both sides of the edges of the receptacle 11 on the drive side 17 of the hybrid rotor 1. Said undercuts 14 are configured complementary to the locking protrusions 35 of the fixed angle container 3 such that the locking protrusions 35 engage the undercut 14 when the fixed angle container 3 is mounted on the hybrid rotor 1. By means of said engagement, the fixed angle container 3 acts like a clamp to the opening edges of the rotor by means of the interaction of the inclined faces and counteracts a spreading of the hybrid rotor 1 on the receptacle 11. The force acting against a spreading of the hybrid rotor 1 at the receptacle 11 increases along with an increasing rotational speed of the hybrid rotor 1. This measure also increases the service life of the hybrid rotor 1.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A hybrid rotor for a centrifuge having a drive shaft for rotating the hybrid rotor about a rotation axis (R), the hybrid rotor comprising:

a rotor base body having a receptacle side, a drive side, and a lateral wall;

a plurality of receptacles arranged on the receptacle side of the rotor base body, each having an insertion opening for a respective one of a plurality of centrifuge containers, wherein the receptacle side is a side of the rotor base body configured for a user to insert one of the plurality of centrifuge containers into a respective one of the plurality of receptacles, and wherein the drive side is a side of the rotor base body located opposite the receptacle side and is configured for a user to fix the drive shaft to the rotor base body; and an open structure provided in an outer periphery of the rotor base body on the drive side and in the lateral wall, the open structure being configured to allow respective free ends of the plurality of centrifuge containers to protrude from the rotor base body, wherein at least one receptacle comprises both a rotary bearing for rotatably mounting a swinging container and a fixed bearing for fixedly mounting a fixed angle container in the receptacle, wherein the fixed bearing comprises a planar support for receiving a collar of a fixed angle container, the planar support being arranged around the respective insertion opening, wherein the rotary bearing comprises two rounded recesses for receiving a respective trunnion of a swinging container, which recesses are arranged opposite each other adjacent the respective insertion opening, and wherein the two rounded recesses are arranged in a region of the planar support of the fixed bearing and sunk into the planar support.

2. The hybrid rotor according to claim 1, wherein the planar supports of multiple fixed bearings are arranged directly next to one another in the direction of rotation such that the planar supports form a ring, the rotation axis (R) being in the center of said ring.

3. The hybrid rotor according to claim 1, wherein the planar support of the at least one fixed bearing slopes down in an inclined manner from the drive side of the hybrid rotor towards the rotation axis (R).

4. The hybrid rotor according to claim 1, wherein the planar support of the at least one fixed bearing is formed in the shape of a trapezoid.

5. The hybrid rotor according to claim 1, wherein the fixed bearing, viewed from the receptacle side, is arranged in front of the rotary bearing.

6. A set for a centrifuge, comprising:

a hybrid rotor according to claim 1, and at least one fixed angle container.

7. The set according to claim 6, wherein the at least one fixed angle container comprises a collar which is configured complementary to the planar support of the fixed bearing of the hybrid rotor so that the collar rests against the support of the fixed bearing in a form-fitting manner such that the fixed angle container is prevented from swinging.

8. The set according to claim 6, wherein the at least one fixed angle container comprises a trunnion which is configured complementary to the recess of the rotary bearing of the hybrid rotor and rests in the recess of the rotary bearing of the hybrid rotor.

9. The set according to claim 6, wherein the at least one fixed angle container comprises two locking protrusions, and that the rotor base body on its drive side comprises an undercut on both sides at the edges of the receptacle, the locking protrusions engaging the undercut when the fixed angle container is supported in the receptacle.

10. A fixed angle container for use in a hybrid rotor according to claim 1, wherein the fixed angle container comprises a swinging container having a detachable adapter arranged thereon, the adapter comprising a collar which is configured complementary to a fixed bearing of the hybrid rotor.

11. The hybrid rotor according to claim 1, wherein each receptacle comprises both a rotary bearing and a fixed bearing.

12. The hybrid rotor according to claim 1, wherein the support completely surrounds the insertion opening in a radial direction relative to the insertion opening.

13. The set according to claim 7, wherein the collar is formed in the shape of a trapezoid.

14. A fixed angle container for use in a set according to claim 6, wherein the fixed angle container comprises a swinging container having a detachable adapter arranged thereon, the adapter comprising a collar which is configured complementary to a fixed bearing of the hybrid rotor.

* * * * *